US011587385B2

(12) United States Patent
Kratochvil et al.

(10) Patent No.: US 11,587,385 B2
(45) Date of Patent: Feb. 21, 2023

(54) SECURITY REVOLVING DOOR ASSEMBLY

(71) Applicant: IRD Group, Inc., Evansville, IN (US)

(72) Inventors: Jim Kratochvil, Evansville, IN (US); Joshua Kratochvil, Evansville, IN (US); Matthew Hartig, Evansville, IN (US)

(73) Assignee: IRD Group, Inc., Evansville, IN (US)

( * ) Notice: Subject to any disclaimer, the term of this patent is extended or adjusted under 35 U.S.C. 154(b) by 729 days.

(21) Appl. No.: 16/583,559

(22) Filed: Sep. 26, 2019

(65) Prior Publication Data

US 2020/0098212 A1 Mar. 26, 2020

Related U.S. Application Data

(60) Provisional application No. 62/736,912, filed on Sep. 26, 2018.

(51) Int. Cl.

| | |
|---|---|
| ***G07C 9/00*** | (2020.01) |
| ***E05G 5/02*** | (2006.01) |
| ***E06B 3/90*** | (2006.01) |
| ***E05G 5/00*** | (2006.01) |
| ***G07C 9/30*** | (2020.01) |
| ***G07C 9/15*** | (2020.01) |

(52) U.S. Cl.

CPC ..... *G07C 9/30* (2020.01); *E05G 5/003* (2013.01); *E05G 5/02* (2013.01); *E06B 3/90* (2013.01); *G07C 9/15* (2020.01)

(58) Field of Classification Search

CPC .. G07C 9/30; G07C 9/15; E05G 5/003; E05G 5/02; E06B 3/90

See application file for complete search history.

(56) References Cited

U.S. PATENT DOCUMENTS

| | | | | |
|---|---|---|---|---|
| 5,542,211 | A * | 8/1996 | Colombo | E05G 5/003 109/8 |
| 2005/0045078 | A1* | 3/2005 | Chen | E05F 15/608 109/8 |
| 2005/0280814 | A1* | 12/2005 | Iuliano | G01N 21/65 356/301 |
| 2008/0110093 | A1* | 5/2008 | Liles | E05F 15/74 49/506 |
| 2017/0234054 | A1* | 8/2017 | Kumar | E05F 15/73 49/324 |

* cited by examiner

*Primary Examiner* — Thomas D Alunkal

(74) *Attorney, Agent, or Firm* — Martin IP Law Group; C. Richard Martin

(57) ABSTRACT

A security revolving door assembly including a revolving door, a controlling unit and a LIDAR sensor. The LIDAR sensor is appropriately disposed in the top or canopy of the revolving door and advantageously directed downwardly into the passage space of the revolving door. In particular, a first LIDAR sensor is centrally disposed in a first quadrant of the canopy, and a second LIDAR sensor is centrally disposed in a third quadrant of the canopy.

10 Claims, 3 Drawing Sheets

FIG. 2
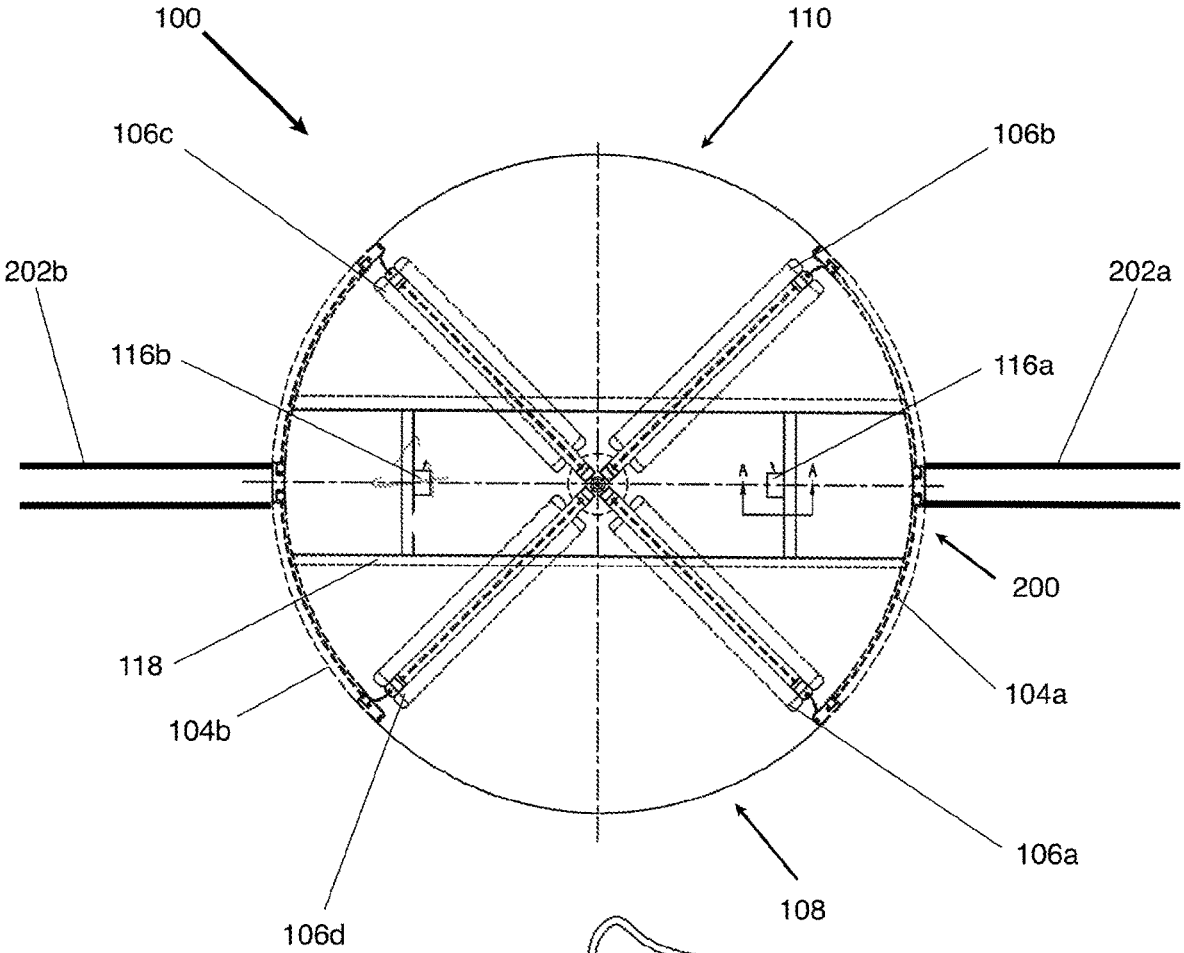
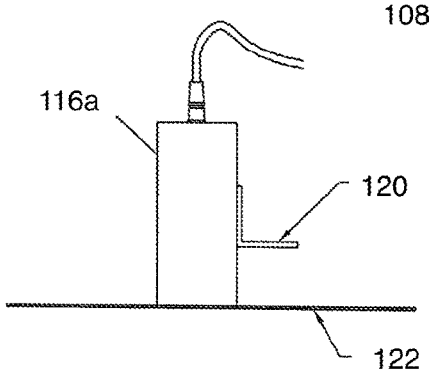
FIG. 3

SECURITY REVOLVING DOOR ASSEMBLY

BACKGROUND OF THE INVENTION

1. Field of the Invention.

The present invention relates to revolving doors commonly installed at an entrance of a building, and in particular a security revolving door system for both private buildings and public facilities through which persons travel.

2. Description of the Related Art.

Revolving doors are generally used in particular as imposing, eye catching, energy efficient, and often a security access solution for an entryway to a building. Such revolving doors may be installed outside or inside a frontage wall or in the center of a wall. In most general terms, a revolving door is often installed at an entrance of a building and enables people and various things to pass through the revolving door.

Many different schemes have been proposed for controlling and monitoring access through a revolving door. Of course, there are known schemes for identifying individuals. In general, these identification schemes may infer an individual's identity based upon knowledge of restricted information (e.g., a password), possession of a restricted article (i.e., a passkey), or one or more inherent physical features of the individual (e.g., a matching reference photo or biometric indicia).

Each of the above-mentioned access controlled schemes, however, may be compromised by an unauthorized person who follows immediately behind (i.e., tailgates) or passes through an access control space at the same time as (i.e., piggybacks) an authorized person who has been granted entry.

Different methods of detecting tailgaters and piggybackers have been proposed. Most of these systems, however, involve the use of a complex door arrangement that defines a confined space through which a person must pass before being granted entry. For example, in one anti-piggybacking sensor system for a revolving door, an alarm signal is triggered if more than one person is detected in one or more of the revolving door compartments at any given time. In another approach, a security enclosure for a door frame included two doors that define a chamber unit that is large enough for only one person to enter at a time to prevent unauthorized entry by tailgating or piggybacking.

As described, problems associated with the provision of a suitable operable security door system including a revolving type security door have been particularly difficult. As will be seen from the subsequent description, the preferred embodiments of the present invention overcome the described shortcomings of the prior art.

Accordingly, there is a need for a simple, economical system for detecting tailgaters and piggybackers in a revolving door.

SUMMARY OF THE INVENTION

It is therefore an objective of the present invention to provide a security revolving door system that effectively prevents unauthorized persons or objects from passing through a revolving door.

The present invention meets this objective by providing a security revolving door system that is capable of overcoming the aforementioned drawbacks of the prior art. The described security system is directed to an improved security door system operable to substantially prevent unauthorized persons or objects from passing through a revolving door entry. In the broadest context, the revolving security door system consists of components configured and correlated with respect to each other so as to attain the desired objective.

According to one presently preferred embodiment of the invention, there is provided a security revolving door assembly comprising a revolving door, a sensor, a control unit, and action means. The revolving door includes a vertical rotary shaft extending upward from a base surface, a pair of opposing vertical lateral walls, each spaced a distance from the rotary shaft thereby defining an exterior opening and an interior opening, a plurality of door wings, each extending laterally from the rotary shaft the distance to the vertical walls and each of the plurality of doors being space equidistant from adjacent ones of the plurality of door wings. The sensor may be positioned proximate to a trap space defined by two adjacent door wings and one of the lateral walls. The sensor includes means for detecting the presence and shape of objects in the trap space. The control unit may be electrically coupled to the sensor and includes means for reading data from the sensor and determining the presence of a hazard. The action means may be electrically coupled to the control unit for triggering a response to the presence of a hazard.

According to one aspect of the present invention, the sensor is a LIDAR sensor, and is located inside a canopy above the revolving door and directed downwardly at the trap space.

According to another aspect of the invention, two sensors are provided. The first sensor may be positioned proximate to a trap space defined by first and second adjacent door wings and a first lateral wall. The second sensor may similarly be positioned proximate to a second trap space defined by third and fourth adjacent door wings and a second lateral wall.

According to one aspect of the invention, the action means includes an alarm. Alternatively or in addition, the action means may include a lock that is engaged to prevent further rotation of the revolving door. The lock may engage a drive unit attached to the vertical shaft which imparts rotary motion to the revolving door.

The means for reading data from the sensor and determining the presence of a hazard may preferably include a processing unit, memory and software which are programmed to recognize standard occupants in the revolving door assembly and trigger the action means when a non-standard occupant is detected.

These and other objects, features and advantages of the present invention will become apparent from a review of the following drawings and detailed description of the preferred embodiments of the invention.

BRIEF DESCRIPTION OF THE DRAWINGS

The present invention can best be understood in connection with the accompanying drawings. It is noted that the invention is not limited to the precise embodiments shown in the drawings, in which:

FIG. 2 is a top plan view of the security revolving door assembly shown in FIG. 1.

FIG. 3 is a detailed view of a sensor of the security revolving door assembly taken along the line A-A in FIG. 2.

DETAILED DESCRIPTION OF THE INVENTION

Figure 1:
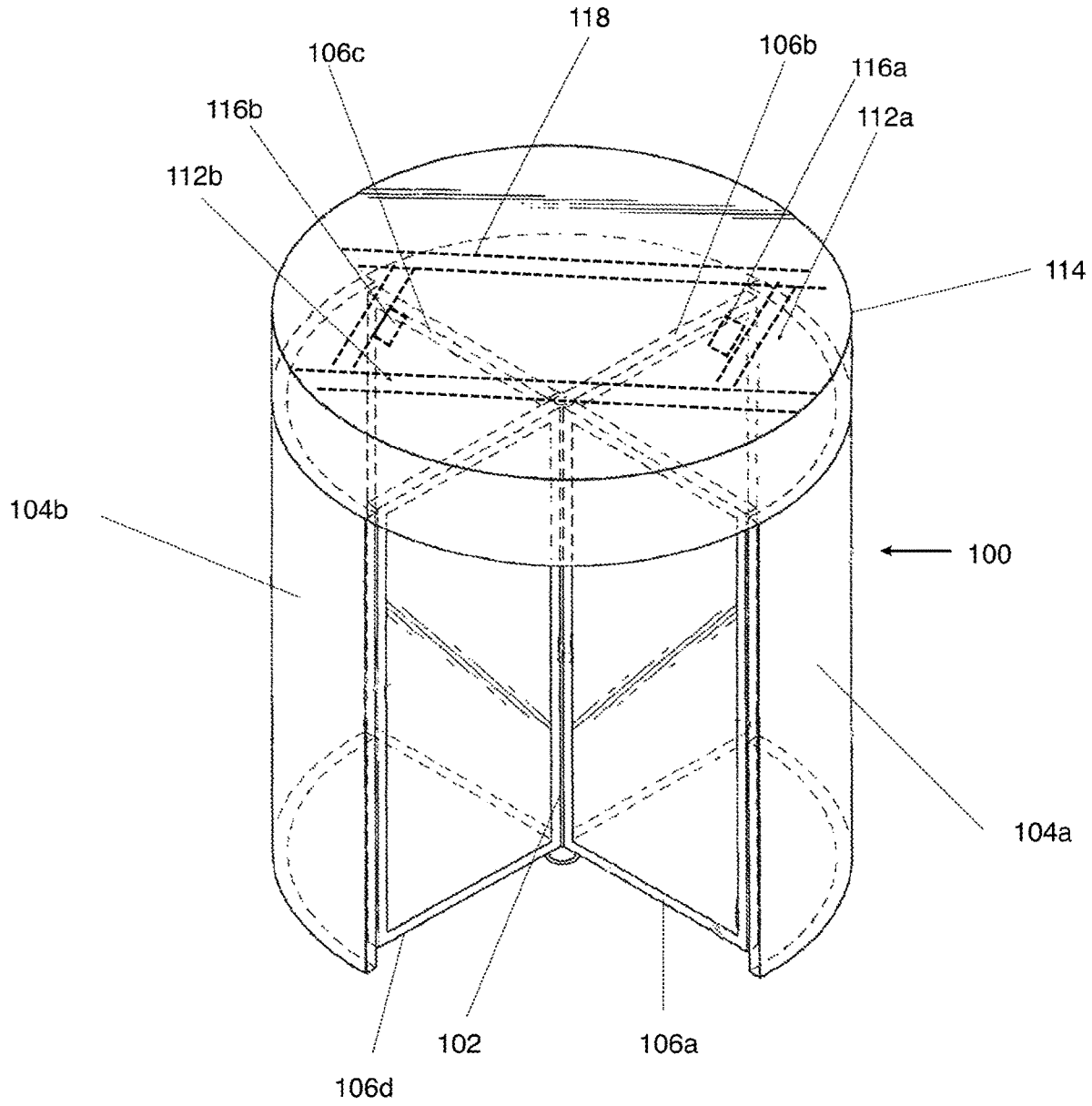
FIG. 1 is a perspective view of the preferred embodiment of the present invention, a security revolving door assembly.
Figure 4:
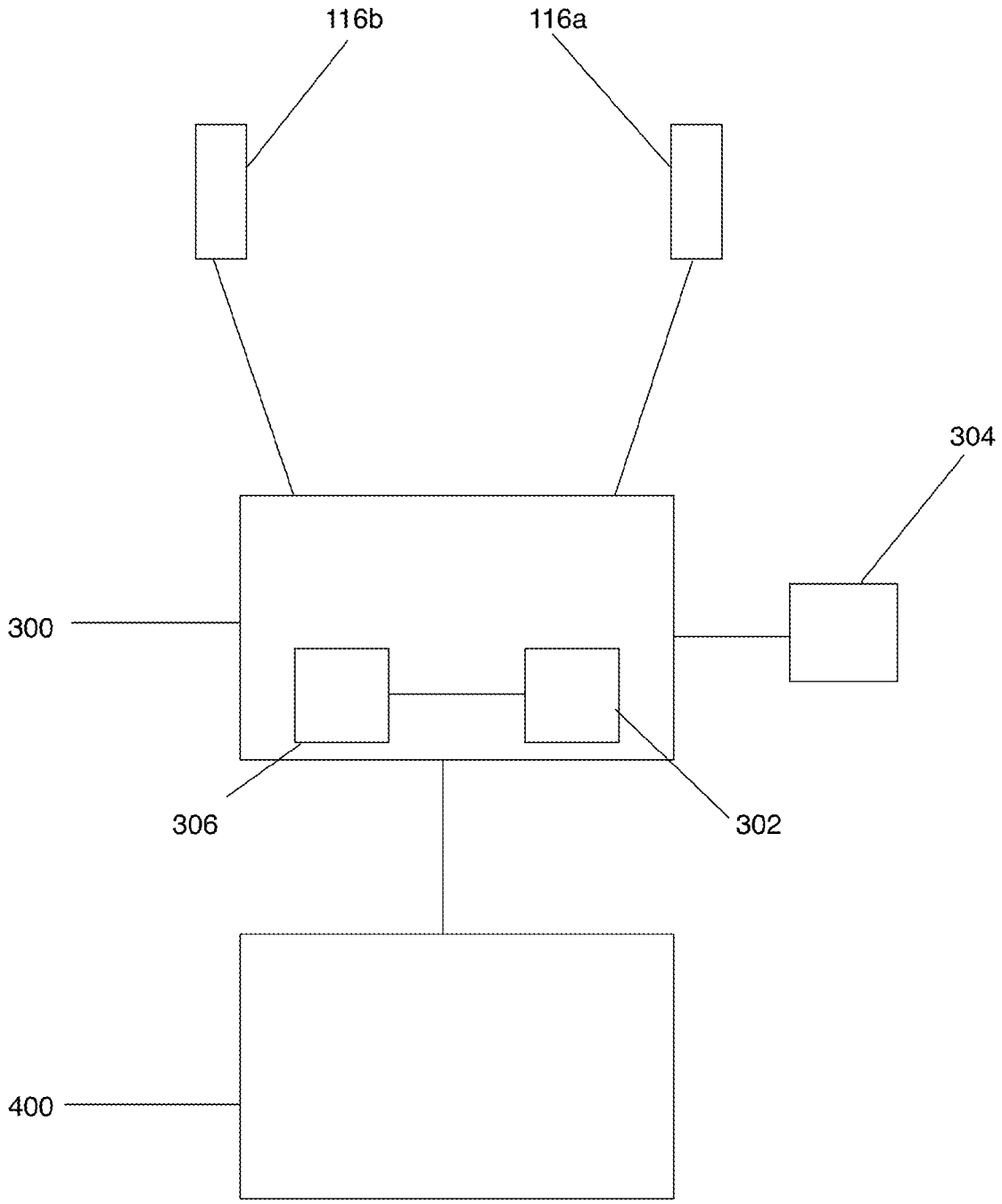
FIG. 4 is a block diagram of the control components of the security revolving door assembly according to a preferred embodiment of the invention.

For purposes of promoting and understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention that would normally occur to one skilled in the art to which the invention relates.

One presently preferred embodiment of the invention comprises a security revolving door assembly 10 for use in connection with a revolving door 100. As best shown in FIG. 1, the revolving door 100 is substantially similar to other currently available revolving doors and includes a rotary vertical shaft 102 with a bottom portion journaled to the ground of an opening or gate 200 in a conventional manner, two opposite vertical lateral walls 104*a*, 104*b*, each of which has an arc-shaped cross-section and extends circumferentially relative to the vertical shaft 102, and a plurality of door wings 106*a*, 106*b*, 106*c*, 106*d* mounted on and extending radially from the shaft 102 toward the lateral walls 104*a*, 104*b*. The lateral walls 104*a*, 104*b* are connected to and are disposed between two outer walls 202*a*, 202*b* of the gate 200. The revolving door 100 has an entrance side 108 from an exterior of the building or space and an exit side 110 to the interior of the building or space opposite to the entrance side 108.

As best shown in FIG. 2, the door wings 106*a*, 106*b*, 106*c*, 106*d* are equiangularly spaced apart about the shaft 102, and have distal ends disposed away from the shaft 102. The door wings 106*a*, 106*b*, 106*c*, 106*d* are rotatable along with the shaft 102, and define with each lateral wall 104*a*, 104*b* a trap space 112*a*, 112*b*, respectively when a successive pair of door wings reach positions at the edges of the lateral walls 104*a*, 104*b*. For example, as shown in FIG. 2, first and second door wings 106*a*, 106*b* are shown positioned at the edges of lateral wall 104*b* and third and fourth door wings 106*c*, 106*d* are shown positioned at the edges of lateral wall 104*a* forming trap space 112*b*. In the preferred embodiment shown in the drawings, the revolving door 100 has four door wings 106*a*, 106*b*, 106*c*, 106*d*, each of which forms an angle of 90° with an adjacent door wing. Alternative configurations of equally space door wings, such as a three-wing door, are also contemplated and included within the scope of the present invention.

A canopy 114 is disposed above the door wings 106*a*, 106*b*, 106*c*, 106*d*. A drive mechanism and control until (not shown) may be located in the canopy, or alternatively below ground at the other end of the drive shaft 102, and are operable so as to impart or stop rotation of the door wings 106*a*-106*d* upon the occurrence of a triggering event such as the presence of a person who has entered the proper security measures to activate the door.

The drive mechanism and control unit (not shown) are in communication with one or more sensors 116*a*, 116*b* that are configured and positioned to trigger an alarm to warn security personnel that an unauthorized person (maybe a tailgater or piggybacker) is attempting to gain entry, and/or to prevent further rotation of the door thereby preventing unauthorized access. The control unit manages the spatial data of the scene on the basis of the available distance data and image data received from the sensors 116*a*, 116*b*. The controlling unit makes the data of the scene available for further use via a network, which is not illustrated, to its safety and assistance systems in the building structure.

As best shown in FIG. 2, the sensors 116*a*, 116*b* are appropriately disposed in the canopy 114 of the revolving door 100 and advantageously directed downwardly into the corresponding trap spaces 112*a*, 112*b*. In particular, a first sensor 116*a* is centrally disposed in the canopy 114 above the first, entrance trap space 112*a*, and a second sensor 116*b* is centrally disposed in the canopy 114 above the second, exit trap space 112*b*. Each sensor 116*a*, 116*b* is mounted to a mounting frame 118 disposed in the canopy 114 by a mounting bracket 120 such that the sensor 116*a*, 116*b* is positioned above the ceiling 122 of the revolving door 100 and directed downward into the respective trap space 112*a*, 112*b*. Accordingly, a person or object entering the first, entrance trap space 112*a* defined between two door wings 106*a*, 106*b* would be detected by the sensor 116*a*. Similarly, a person or object entering the second, exit trap space 112*b* defined between two door wings 106*c*, 106*d* would be detected by the sensor 116*b*. However, the sensors 116*a*, 116*b* will also detect the presence of a door wing as the door rotates. Accordingly, the sensors 116*a*, 116*b* are operable to detect the presence of the person passing through the revolving passage as the rotating door rotates.

According to a preferred embodiment of the present invention, the sensors 116*a*, 116*b* are LIDAR sensors. LIDAR is a surveying method that measures distance to a target by illuminating the target with laser light and measuring the reflected light with a sensor. Differences in laser return times and wavelengths can then be used to make digital 3-D representations of the target. The use of the LIDAR sensors 116*a*, 116*b* coupled to the controlling unit ensures unambiguous detection and classification of persons and objects that are using the revolving door.

In order to evaluate object data obtained using the LIDAR sensors 116*a*, 116*b*, the controlling unit receives the object identification and image data from the LIDAR sensors 116*a*, 116*b*. The control unit 300 receives the data from the LIDAR sensors 116*a*, 116*b* and includes means for estimating or detecting a hazard potential. The means for estimating or detecting a hazard potential typically comprises a processing unit 302 and software which interprets the data gathered from the lasers in the LIDAR sensors 116*a*, 116*b*. The software is programmed such that it will allow access to detected shapes that are consistent with the presence of a single human subject in the relevant trap space 112*a*, 112*b*. If the programming of the processing unit 302 determines that the detected shape is consistent with two or more persons in the trap space (piggybacker), or if the processing unit detects another shape in the trap space after the person has passed through the trap space (tailgater), further action, as described below is taken.

LIDAR uses ultraviolet, visible, or near-infrared light to image objects. According to one advantageous refinement to the present invention, the LIDAR sensor uses a surveying method that measures distance to a target by illuminating the target with pulse laser light and measuring the reflected pulses with the sensor. Differences in laser return times and wavelengths can then be used to make digital representations of the target. The control unit 300 may further include storage means such as computer memory 306 can maintain record of the digital representations generated by the LIDAR sensor in order to manage persons and objects that access the security revolving door and better identify for example, attempts at tailgating and piggybacking.

In some embodiments, when detecting a potential hazard such as described above, the control unit 300 may trigger an alarm 304 (e.g., an audible or visible alarm) to warn security personnel that unauthorized personnel for example, are using the revolving door entry. In other implementations, the signal triggers a response suitable to the environment in which the security system is implemented. For example, the action signal may cause the control unit 300 to lock the drive unit 400 effectively stopping rotation of the revolving door until a human administrator overrides the signal. Alternatively, the control unit 300 could cause the drive unit 400 to reverse direction moving the subject back out to the entrance side 108 or exit side 110 effectively denying the subject transfer through the revolving door.

Preferred embodiments of a security door system and methods of operation have been described herein. Conventional engineering materials and practices may be used to construct the door system and the associated controls. However, those skilled in the art will recognize that various substitutions and modifications may be made to the rotating door system and its methods of operation without parting from the scope and spirit of the appended claims. Thus, it is apparent that there has been provided, in accordance with this invention, a security revolving door system that fully satisfies the objectives, aims and advantages set forth above.

Although the above description above contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus, the scope of the invention should be determined by the appended claims in the formal application and their legal equivalents, rather than by the examples given.

We claim:

1. A security revolving door assembly comprising:

a revolving door having a vertical rotary shaft extending upward from a base surface, a pair of opposing vertical lateral walls, each spaced a distance from the rotary shaft thereby defining an exterior opening and an interior opening, a plurality of door wings, each extending laterally from the rotary shaft the distance to the vertical walls and each of said plurality of doors being space equidistant from adjacent ones of the plurality of door wings;

a sensor positioned proximate to a trap space defined by two adjacent door wings and one of said lateral walls, said sensor including means for detecting the presence and shape of objects in said trap space;

a control unit electrically coupled to said sensor, said control unit including means for reading data from said sensor and determining the presence of a hazard; and action means electrically coupled to said control unit for triggering a response to the presence of a hazard.

2. The security revolving door assembly of claim 1 wherein said sensor is a LIDAR sensor.

3. The security revolving door assembly of claim 2 wherein said sensor is located inside a canopy above said revolving door and directed downwardly at said trap space.

4. The security revolving door assembly of claim 1 wherein said sensor includes two sensors, the first sensor positioned proximate to a trap space defined by first and second adjacent door wings and a first lateral wall, and said second sensor positioned proximate to a second trap space defined by third and fourth adjacent door wings and a second lateral wall.

5. The security revolving door assembly of claim 4 wherein said sensors are LIDAR sensors.

6. The security revolving door assembly of claim 5 wherein said sensors are located inside a canopy above said revolving door and directed downwardly at said trap spaces.

7. The security revolving door assembly of claim 1 wherein said action means includes an alarm.

8. The security revolving door assembly of claim 1 wherein the action means includes a lock that is engaged to prevent further rotation of the revolving door.

9. The security revolving door assembly of claim 8 wherein the lock engages a drive unit attached to the vertical shaft which imparts rotary motion to the revolving door.

10. The security revolving door assembly of claim 1 wherein said means for reading data from said sensor and determining the presence of a hazard includes a processing unit, memory and software which are programmed to recognize standard occupants in the revolving door assembly and trigger said action means when a non-standard occupant is detected.

* * * * *